US005421778A

United States Patent [19]

Kouramanis

[11] Patent Number: 5,421,778

[45] Date of Patent: Jun. 6, 1995

[54] SHIPPING LABEL

[75] Inventor: Lyn J. Kouramanis, Scarborough, Canada

[73] Assignee: Merisel Canada Inc., Concord, Canada

[21] Appl. No.: 945,386

[22] Filed: Sep. 16, 1992

[30] Foreign Application Priority Data

Jun. 22, 1992 [CA] Canada ..... 2071807

[51] Int. Cl.[6] ..... B42D 15/04

[52] U.S. Cl. ..... 462/2; 462/64; 283/79; 229/304

[58] Field of Search ..... 229/74, 68 R, 301, 304, 229/305; 462/2, 6, 54, 64; 283/79, 80

[56] References Cited

U.S. PATENT DOCUMENTS

| | | | |
|---|---|---|---|
| Re. 30,114 | 10/1979 | Juszak et al. | 229/305 |
| 3,111,336 | 11/1963 | Schumacher | 462/64 |
| 3,554,438 | 1/1971 | Malderghem | 462/64 |
| 3,942,714 | 3/1976 | Wise | 229/305 |
| 3,977,597 | 8/1976 | Wise et al. | 462/65 |
| 3,987,960 | 10/1976 | Gardiner | 229/74 |
| 4,103,821 | 8/1978 | Gartshore et al. | 229/74 X |
| 4,121,961 | 10/1978 | Brunette et al. | 283/80 X |
| 4,153,163 | 5/1979 | Alderman et al. | 462/64 |
| 4,830,269 | 5/1989 | Jenkins | 229/305 |
| 4,938,505 | 7/1990 | Gruttemeyer et al. | 462/2 X |
| 5,015,137 | 5/1991 | Stenner | 229/301 |
| 5,071,167 | 12/1991 | O'Brien | 283/79 |

*Primary Examiner*—Timothy V. Eley
*Assistant Examiner*—K. Nguyen
*Attorney, Agent, or Firm*—Spencer, Frank & Schneider

[57] ABSTRACT

A shipping label to be affixed to a package to be delivered payment on delivery ("C.O.D.") by a courier service or the like includes a plurality of stacked panels. The rear face of the shipping label's back panel is covered with an adhesive to secure the label to the package to be delivered. The front face of the shipping label's top panel provides package delivery information, other client information and the cost of the package being delivered. Between the top and bottom panels is an intermediate panel with delivery information on it relevant to the recipient of the package. A return envelope constituted by a pair of panels joined together along three of their sides is located between the intermediate panel and the back panel. One side of the envelope is open to receive a cheque or other suitable monetary payment in the amount shown on the front face of the top panel. One of the panels of the envelope has a flap which can be folded to seal the open end of the envelope. Adhesive on the flap adheres to the other panel of the envelope and maintains the envelope in a closed condition once payment for the package has been received and placed in the envelope. The envelope is removable from the shipping label and is treated by the courier as a new package to be delivered.

14 Claims, 5 Drawing Sheets

SHIPPING LABEL

FIELD OF THE INVENTION

The present invention relates to shipping labels for courier deliveries and the like and in particular to a shipping label to be attached to a package to be delivered "Cash on Delivery" ("COD") which provides a return envelope for the monetary payment received upon delivery of the package.

BACKGROUND OF THE INVENTION

Shipping labels and mailers are well known in the art and various designs have been considered to enhance destination address information, to guard against separation between the package being delivered and the shipping label, and to provide receipts for both the courier delivering the package and the recipient of the package.

For example, U.S. Pat. No. 3,554,439 to Malderghem and assigned to Moore Business Forms Inc. shows a mailer formed from a number of overlying, stacked panels. A main envelope is constituted by the two outer most sheets of the mailer. The sheets are joined at their ends to a pair of marginal strips. Between the sheets is a return mailing envelope along with other additional sheets. The envelope and other sheets are also joined at their ends to the marginal strips. Each of the sheets however is separable from the marginal strips along a row of perforations.

U.S. Pat. No. 3,111,336 to Schumacher shows a billing envelope which is mailed to a client. The envelope includes a removable portion forming the client's copy of the :statement, and a return envelope for the client's payment.

U.S. Pat. No. 3,942,714 to Wise shows a two way mailer including an inner, return envelope formed by a pair of sheets over which a cover sheet is located. The destination address is typed on the front of the cover sheet and the return address is typed on the front sheet of the envelope. The cover sheet overlies the front sheet of the envelope. When the envelope is delivered to the destination address shown on the cover sheet, the cover sheet is removed revealing the address typed on front sheet of the envelope. A cheque or other payment is inserted into the envelope which is then sealed and dispatched to the return address.

U.S. Pat. No. 4,830,269 to Jenkins shows a two way mailer which is optimized for manufacture and use. The mailer is formed from a single web of paper which is perforated, folded and gummed at appropriate locations to form the two way mailer.

U.S. Pat. No. 3,987,960 to Gardiner shows a booklet of shipping forms which includes a removable label for attachment to a parcel. U.S. Pat. No. 4,153,163 to Alderman et al. shows a shipping form with an integral envelope to be attached to a parcel and containing copies of shipping forms. U.S. Pat. No. 5,015,137 to Stenner shows a booklet of advertising materials including a business reply envelope.

Although the above-identified prior art mailers and labels are satisfactory, improved labels to facilitate COD deliveries are continuously being sought. It is therefore an object of the present invention to provide a novel shipping label.

SUMMARY OF THE INVENTION

According to the present invention there is provided a shipping label to be placed on a package to be delivered payment on delivery comprising:

a back panel having adhesive means on one face thereof to contact said package to be delivered to secure said shipping label to said package;

a front panel overlying the back panel and having a front face with package destination information thereon;

an envelope disposed between said front and back panels, said envelope being constituted by a pair of overlying panels, said envelope being separable from said shipping label and adapted to receive payment for said package; and sealing means on one of the panels of said pair to seal the envelope.

Preferably, the entire face of the back panel is covered in a permanent bond adhesive to inhibit removal of the shipping label from the package. It is also preferred that a protective sheet covers the adhesive prior to placement of the shipping label on the package, the protective sheet being removable from the adhesive without affecting the properties of the adhesive.

Preferably, the back panel, front panel and the panels constituting the envelope are joined at their ends to define marginal strips. It is preferred that each of the panels is removable from the marginal strips via lines of weakness. It is also preferred that the lines of weakness are in the form of perforations.

Preferably, an invoicing information area is provided on one panel of the envelope and is sensitized so that similar information placed on the top panel is transferred to the one panel of the envelope. This ensures billing information is always returned with the; payment for the package.

The present invention provides advantages in that the shipping label can be secured to the package in a manner to avoid separation between the package and the shipping label. This ensures that the destination information for the package remains with the package. Also, because an envelope is provided for receiving COD payment for the package and which envelope may provide pre-printed return destination information, payment for the package can be quickly delivered by the courier to the seller of the package. Since invoicing information concerning the original package delivered by the courier is also provided on the envelope, the payment for the package can be easily processed. The present design also provides advantages for the courier in that both the package and the return envelope are considered deliveries for the courier. Furthermore, little manipulation is required to separate the envelope from the marginal strip and seal the envelope making the present label extremely easy to use.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENT

Figure 1:
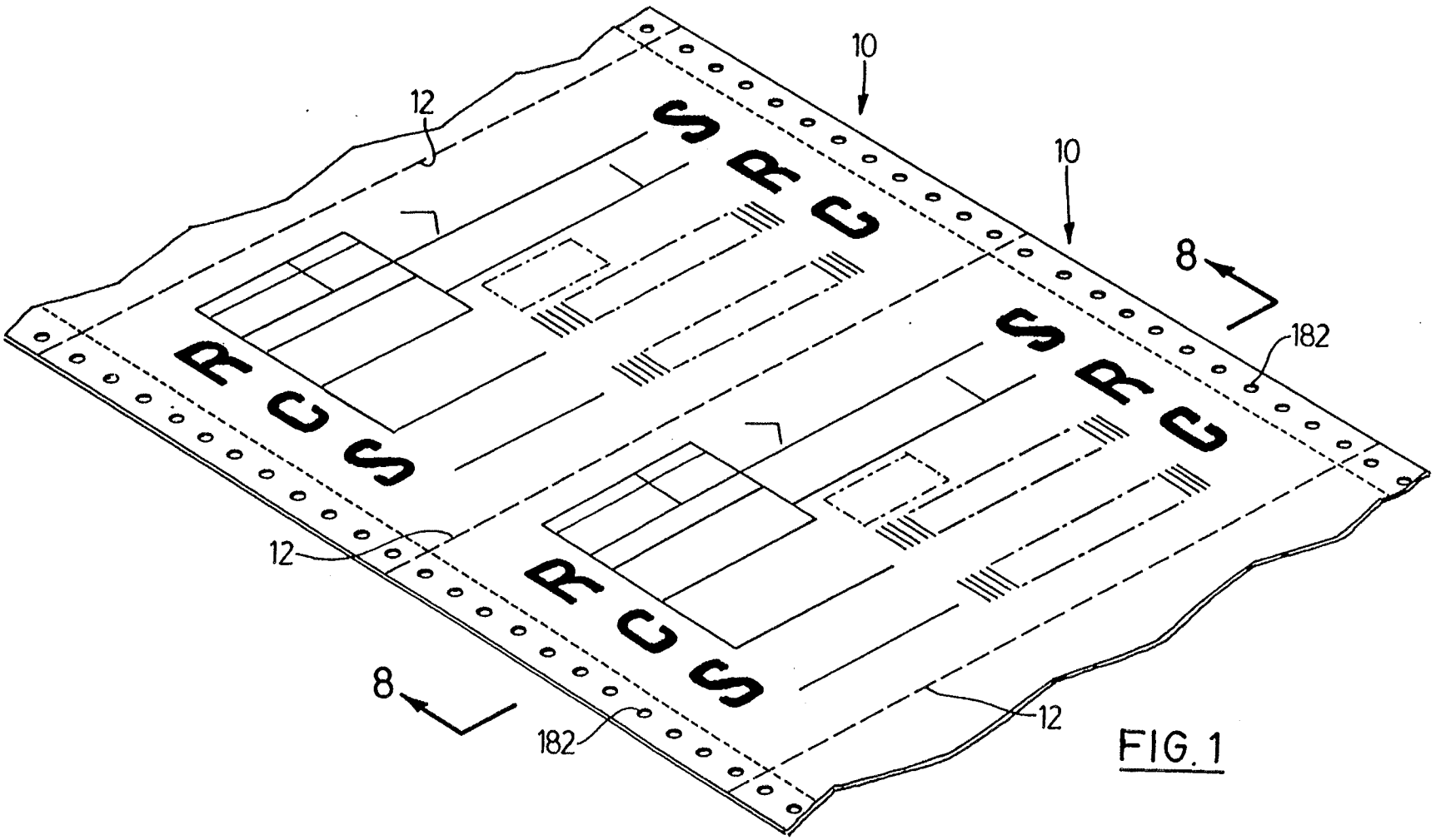
FIG. 1 is a perspective view of a plurality of interconnected shipping labels.

Referring now to FIG. 1, a plurality of shipping labels are shown in a continuous strip and are generally indicated by reference numeral 10. The labels 10 are interconnected by rows of perforations 12 so that individual labels 10 may be removed from the strip. The labels 10 are adapted to be secured to a package to be delivered payment on delivery, commonly referred to in the art as "Cash On Delivery" "COD"), by a courier service or the like.

Figure 2:
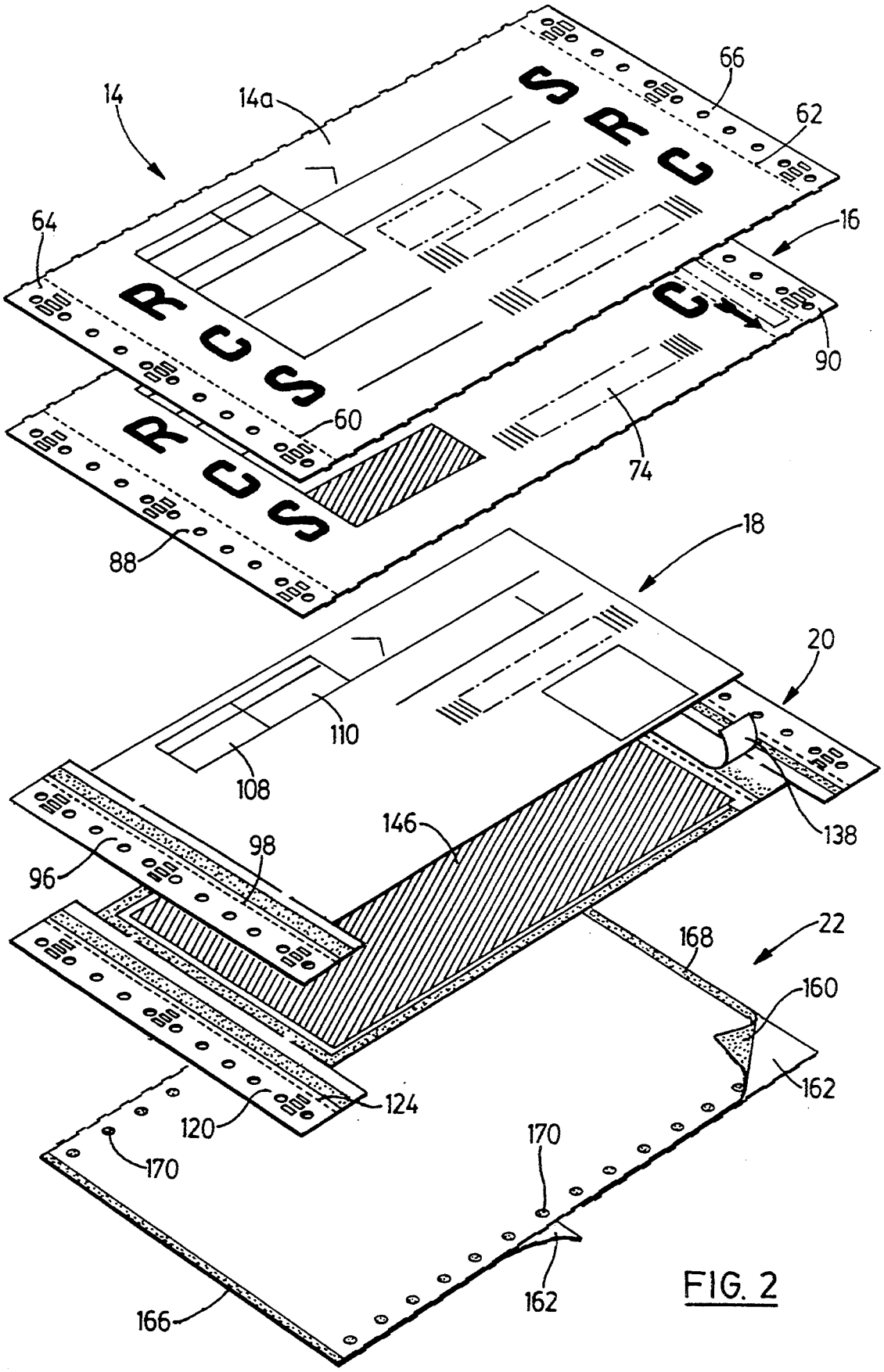
FIG. 2 is exploded perspective view of one of the shipping labels illustrated in FIG. 1.
Figure 3:
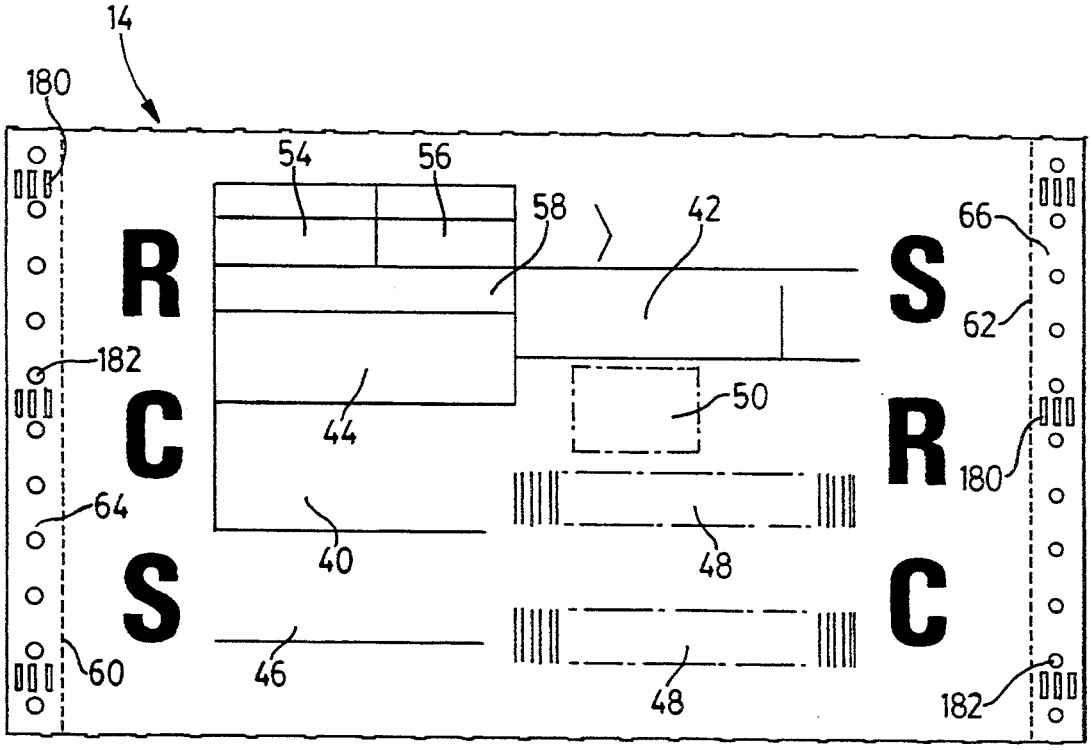
FIG. 3 is a top plan view of one of the panels in the shipping label illustrated in FIG. 2.

FIG. 2 better illustrates one of the labels 10 and as can be seen, the label 10 is formed from a number of stacked panels 14 to 22 joined at their ends. The top panel 14 has a front face 14*a* on which a variety of information is provided concerning the shipping label 10 and the delivery of the package to which the label is to be attached. In particular, the front face 14*a* of the panel 14 includes a destination information area 40 on which the address of the customer receiving the package 12 is provided (see FIG. 3). Also located on the front face is a pricing information area 42 on which the cost of the package 12 to which the label 10 is adhered is placed. A shipper information area 44 is provided on the front face 14*a* above area 40 while a special instruction area 46 is provided below area 40. Optional variable information coding and in this particular example, bar coding 48 used for tracking purposes, can be placed on the front face 14*a* in a convenient location and in this case is shown beneath the pricing information area 42. Reminder information 52 directed to the courier delivering the package 12 is provided. Above the shipper information area 44 are located a customer number area 54, an invoice number area 56, and a purchase order area 58. Information is inserted in these areas prior to attachment of the shipping label 10 to the package 12 as will be described.

At opposite ends of the top panel 14 are located lines of weakness 60 and 62 in the form of perforations. These lines of perforations define a pair of marginal strips 64 and 66 respectively. The perforations allow the majority of the top panel 14 to be separated from the marginal strips. This is done after the information has been placed thereon and the label 10 has been secured to the package. The separated top panel constitutes a receipt for the deliverer of the package.

Figure 4:
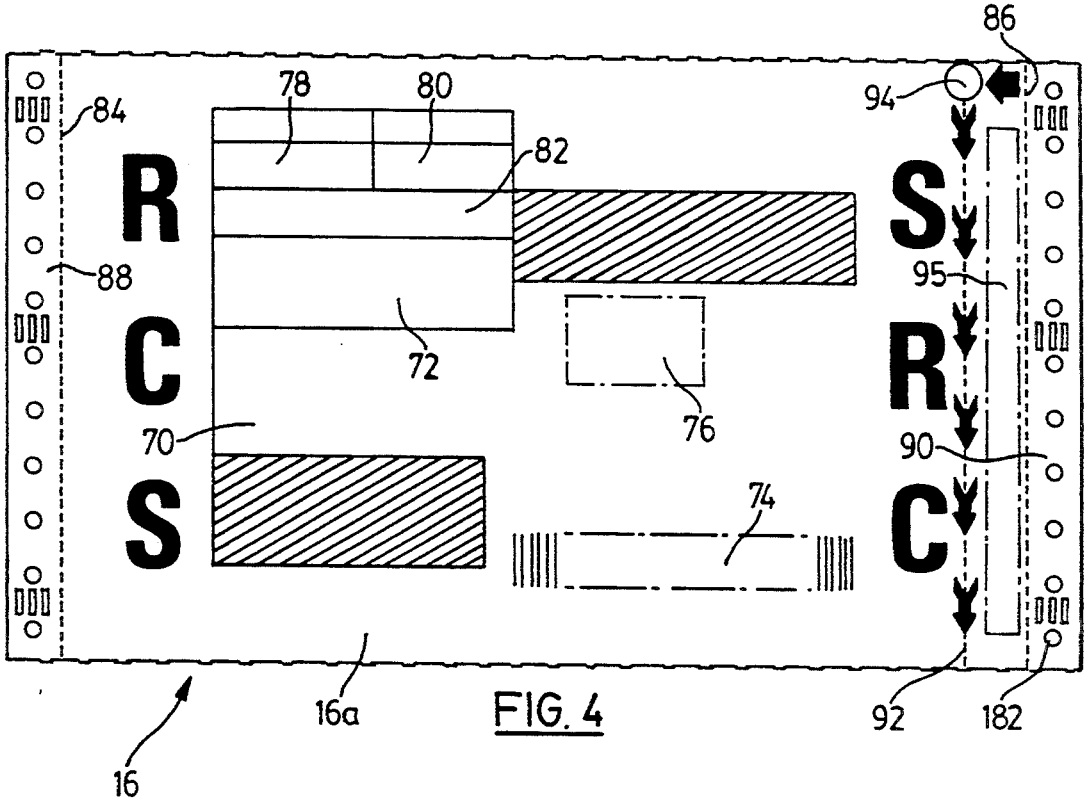
FIG. 4 is a top plan view of another of the panels in the shipping label illustrated FIG. 2.

Beneath the top panel 14 is an intermediate panel 16 which constitutes the customer's receipt for the package being delivered (see FIG. 4). The panel 16 has a front face 16*a* on which areas for information are also provided. In particular, the front face 16*a* provides a destination information area 70 on which the address of the customer receiving the package 12 is received. A shipper information area 72 is provided above area 70. Optional bar coding 74 can be placed on the front face 16*a* and in this case is shown beneath courier reminder information 76 identical to that provided on the top panel 14. Above the shipper information area 72 are located a customer number area 78, an invoice number area 80, and a purchase order area 82. The areas 70, 72 and 78 to 82 are located on the panel 16 directly below the corresponding areas on the top panel 14. In addition, the front face 16*a* of the panel 16 is sensitized so that when information is written on areas 40, 44 and 54 to 58 of the top panel 14, the information is transferred to the corresponding areas 70, 72 and 78 to 82 of the panel 16.

At opposite ends of the panel 16 are also located lines of weakness 84 and 86 in the form of perforations to define a pair of marginal strips 88 and 90 respectively. The perforations 84 and 86 are aligned with those formed in the top panel 14. Spaced from the line of perforations 86 is another line of weakness 92 in the form of perforations. At the top of the line of perforations 92 is located a circular hole 94 to facilitate tearing along the perforations 92. Shipping label opening instruction information 95 is also provided on the panel between the line, of perforations 92 and the perforations 86 defining the marginal strip 90.

Figure 5:
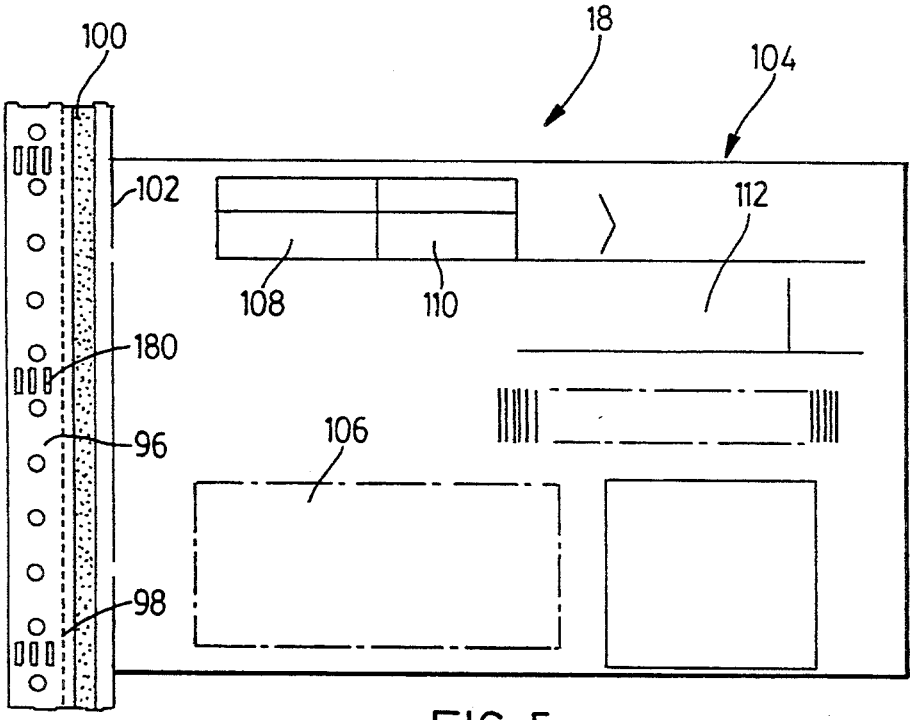
FIG. 5 is a top plan view of yet another of the panels in the shipping label illustrated in FIG. 2.

Beneath the panel 16 is another panel 18, a portion of which constitutes the top panel of a return envelope as will be described (see FIG. 5). The panel 18 is reduced in size as compared to the panels 14 and 16 and has a marginal strip 96 only at one of its ends. Similar to panels 14 and 16, the marginal strip 96 is defined by a line of perforations 98 aligned with the perforations 60 and 84. Spaced from the line of perforations 98 is an adhesive strip 100 which runs parallel to the line of perforations 98. The adhesive strip 100 secures the end of panel 18 to the back face of panel 16 inside the line of perforations 84. Spaced from the adhesive strip 100 is a line of slitter perforations 102. As is known to those of skill in the art, slitter perforations are more easily broken than regular perforations.

The remainder of the panel 18 constitutes the top panel 104 of the return envelope. On the front face of the top panel 104 is a return address information area 106 on which information concerning the party to whom the envelope 60 is to be delivered is placed. The return address information placed in this area 106 may be pre-printed. Above the address information area 106 are areas 108 and 110 to receive customer number and invoice number information. The areas 108 and 110 are aligned with the corresponding areas on panels 14 and 16. A pricing information area 112 is also provided on the top panel 104 and is aligned with area 42 on the top panel 14. The areas 108, 110 and 112 are sensitized so that when information is placed on the corresponding areas of panel 14, the information is transferred to the panel 104.

Figure 6:
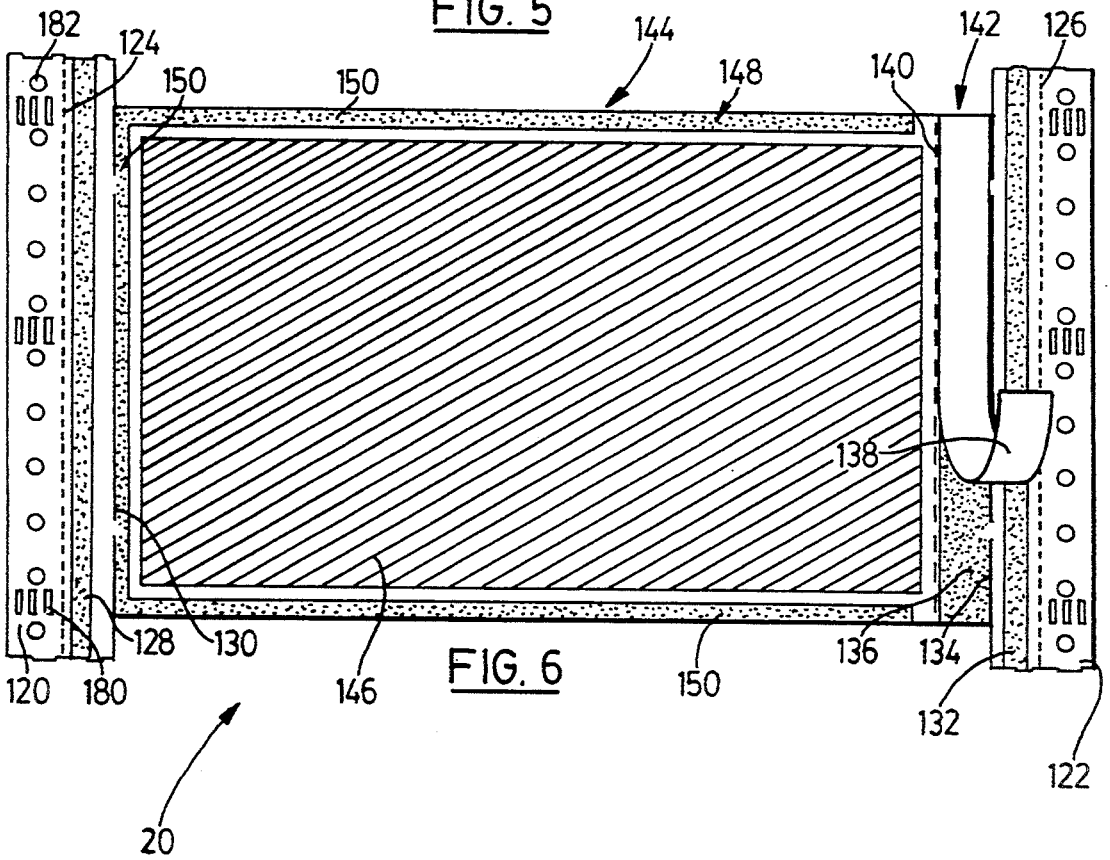
FIG. 6 is a top plan view of still yet another panel in the shipping label shown in FIG. 2.
Figure 7:
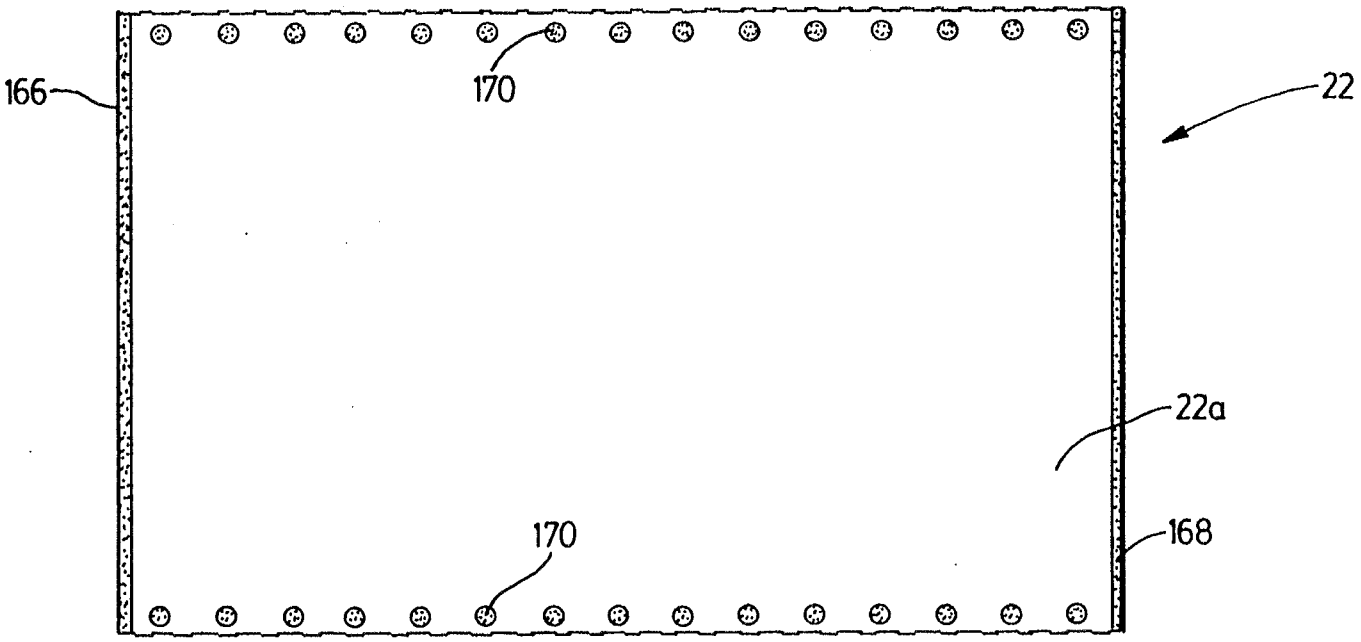
FIG. 7 if a top plan view of still yet another panel in the shipping label shown in FIG. 2.

Another panel 20 is disposed below the panel 18 and is best illustrated is FIG. 6. The panel 18 has marginal strips 120 and 122 at both ends defined by lines of perforations 124 and 126 respectively. Spaced from but parallel to the line of perforations 124 defining marginal strip 120 is an adhesive strip 128 to secure the panel 20 to the back face of panel 18 inside the line of perforations 98. Spaced from the adhesive strip 128 is a line of slitter perforations 130. At the other end of the panel 20, spaced from but parallel to the line of perforations 126 defining marginal strip 122 is another adhesive strip 132. The adhesive strip 132 secures the panel 20 to the back face of panel 16 in the space between the lines of perforations 86 and 92 respectively. Spaced from the adhesive strip 132 is a line or slitter perforations 134. A fold line 140 runs parallel to the slitter perforations 134 and is spaced from them to define a flap 142. An adhesive band 136 is provided on the flap 142 between the slitter perforations 134 and the fold line 140 and is covered by a protective strip 138 which can be removed from the panel 20 by peeling.

Rectangular portions of the panel 20 are removed along opposite sides between the two lines of slitter perforations 130 and 134 to define the back panel 144 of the return envelope. The front face of the back panel 144 between the fold line 140 and the line of slitter perforations 130 has an opaque coating 146. The coating is dimensioned to leave an uncovered rectangular border 148 about the periphery of the back panel 144. Along three of the edges of the border 148 is located adhesive 150 to secure the back panel 144 to the back face of top panel 104 and complete the return envelope. The edge of the border adjacent the fold line 140 is free of adhesive to permit access to the interior of the envelope.

Figure 8:
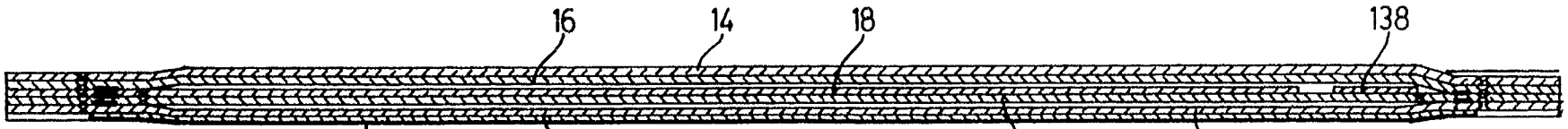
FIG. 8 is a section of FIG. 1 taken along line 8—8.

Beneath the panel 20 is the back panel 22 of the shipping label 10 (see FIG. 8). The entire back face **22*b* of the rear panel is coated with a permanent bond adhesive 160 to contact the package 12 and secure the shipping label 10 to the package. A protective sheet 162 overlies the adhesive 160 without affecting its adhesive properties. The protective sheet is cut 164 so that upon bending of the shipping label 10, a free edge of the protective sheet 162 is exposed facilitating its removal so that the shipping label 10 may be adhered to the package 12 being delivered (see FIG. 2). The front face 22*b* of the rear panel has lines of adhesive 166 and 168 formed along its end edges to secure the back panel 22 to the marginal strips 122 and 124 of panel 20. Spaced adhesive dots 170 run along the side edges of the front face 22*a* to secure the back panel 22 to the panel 18** to inhibit unintentional removal of the customer's receipt from the package being delivered.

The marginal strips of each panel are releasably secured together by fingers 180 punched through the marginal strips. Perforations 182 are also formed in the marginal strips to allow the individual sheets to be form fed into a collator when constructing the present shipping label 10.

In use, when a package 12 is to be delivered, a shipping a label 10 is removed from the strip by tearing along perforations 12. Thereafter, the appropriate information is typed or written onto the front face **14*a* of the panel 14. This information includes the address of the customer receiving the package 12, the cost of the package 12, the shipper delivering the package 12, the invoice number assigned to the package 12, the number assigned to the customer and the purchase order. The sensitization on the front faces of panels 16 and 18 ensure that the appropriate information is transferred to the corresponding areas on the panels 16 and 18. After this is done, the label 10 is folded to expose a comer of the protective sheet 162 adjacent the cut 164 so that the sheet may be peeled off to expose the adhesive 160. The label 10 is then adhered to the package 12** to be delivered.

At this time, the package 12 with the label 10 affixed to it is given to the courier or other delivery service to deliver the package to the customer. Prior to delivering the package, the delivery service removes the top panel 14 by breaking the perforations 62 and 64 and keeps the panel as a receipt. When the courier arrives at the customer location, the courier pushes an object such as a pen in the circular hole 94 to begin tearing along the line of perforations 92. With the tear along the line of perforations started, the courier then pulls on the marginal strip 90 to continue the tear along the line of perforations 92. As the line of perforations 92 breaks, the marginal strip 90 and a portion of the panel 16 separate from the remainder of panel 16. The marginal strip 90 also tears away from the marginal strip 122 on the panel 20 breaking the adhesive bond between the panel 16 and the adhesive strip 132. Once this has been done, the slitter perforations 134 are exposed and can be easily broken. The envelope can then be removed from between panels 16 and 22 22 by pulling on the two panels 104 and 144 constituting the envelope to break the slitter perforations 102 and 130.

Once the envelope is removed from the shipping label 10 in this manner, the courier requests a check in the amount displayed in the pricing information area 112 on the front face **18*a* of the panel 18 and when received inserts the cheque into the-envelope. After this, the protective strip 138 is removed from the adhesive band 136 and the flap 142 is folded about the fold line 140 to contact the front face of the panel 104 and seal the envelope. The envelope is then treated in the same manner as the original package 12 and is delivered to the person at the address written on the front face 18*a* of the top panel 104**. Since the invoice and purchase information is provided on the envelope due to the sensitization and is returned with the cheque, processing of the payment made by the customer is facilitated.

The location of the adhesive strips 100, 128, 132, 166 and 168 prevent accidental separation of the envelope from the shipping label 10 and permit access to the envelope only when the line of perforations 92 is broken. Since this task requires a piercing object, unintentional removal of the envelope is virtually impossible. This design ensures that a return envelope for the payment is always available allowing couriers to complete practically all deliveries.

Although the flap 142 of the envelope has been described as being formed on the panel 20 constituting the back panel of the envelope, it should be apparent that it may aim be formed on the front panel 18 of the envelope provided the adhesive band 136 is properly located to permit the envelope to be sealed when the flap 142 is folded.

We claim:

1. A shipping label to be placed on a package to be delivered payment on delivery comprising:

a back panel having an interior face and an exterior face, said exterior face having adhesive means thereon to contact said package to be delivered to secure said shipping label to said package;

a front panel having an interior face overlying the interior face of said back panel and an exterior face with an area to accommodate package destination information;

an envelope disposed between said front and back panels, said envelope being constituted by a pair of overlying panels, said envelope being separable from said shipping label and adapted to receive payment for said package;

sealing means on one of the panels of said envelope to seal said envelope;

a line of weakness on said front panel, said line of weakness being breakable to permit access to said envelope; and an area on said front panel located between an edge of said front panel and said line of weakness, said area being configured to receive a piercing object to initiate breaking of said line of weakness.

2. A shipping label as defined in claim 1 wherein the entire exterior face of said back panel is covered with a permanent bond adhesive to inhibit removal of said shipping label from said package.

3. A shipping label as defined in claim 2 wherein a protective sheet overlies the adhesive prior to placement of said shipping label on said package, said protective sheet being removable from said adhesive without affecting the properties thereof.

4. A shipping label as defined in claim 1 wherein one of the panels constituting said envelope has a flap thereon, said flap carrying adhesive and being foldable to cover an open end of said envelope when said envelope is separated from said shipping label.

5. A shipping label as defined in claim 4 where said flap carries an adhesive strip covered by a removable protective sheet.

6. A shipping label as defined in claim 1 wherein said front panel has designated areas thereon on which billing information is to be placed, one panel of said envelope having corresponding areas thereon, said shipping label further including transfer means so that information placed on said designated areas is transferred to said corresponding areas.

7. A shipping label to be placed on a package to be delivered payment on delivery comprising:

a front panel having an interior face and an exterior face with an area to accommodate package destination information;

a first intermediate panel behind said front panel and having front and rear faces, said first intermediate panel constituting one panel of a return envelope;

a second intermediate panel behind said first intermediate panel and having front and rear faces, said second intermediate panel constituting another panel of said return envelope, said first and second intermediate panels being secured to one another along three sides thereof to form said return envelope;

a back panel behind said second intermediate panel and having an interior face and an exterior face, said exterior face having first adhesive means thereon to contact said package to be delivered to secure said shipping label to said package;

second adhesive means acting between said front panel and said first intermediate panel along one end thereof;

third adhesive means acting between said first intermediate panel and said second intermediate panel along said one end;

fourth adhesive means acting between said front panel and said second intermediate panel along an end thereof opposite said one end; and fifth adhesive means acting between said back panel and said second intermediate panel along said one end and along an end opposite said one end, wherein said shipping label further includes first lines of weakness in said first and second intermediate panels intermediate the ends thereof, said first lines of weakness being positioned near said respective second and third adhesive means; a second line of weakness in said second intermediate panel intermediate the ends thereof, said second line of weakness being positioned near said fourth adhesive means; and a third line of weakness in said front panel intermediate the ends thereof, said third line of weakness being positioned near said fourth adhesive means, said third line of weakness running substantially parallel to said end opposite said one end, said third line of weakness extending from one edge of said front panel and stopping short of an opposite edge of said front panel to define an area between said third line of weakness and said opposite edge, said area being configured to receive a piercing object to initiate breaking of said third line of weakness, said return envelope being accessible only upon breaking of said third line of weakness, said return envelope being removable from said shipping label upon breaking of said first and second lines of weakness.

8. A shipping label as defined in claim 7 wherein said first, second and third lines of weakness are in the form of perforations formed in the respective panels.

9. A shipping label as defined in claim 8 wherein said first adhesive covers the entire exterior face of said back panel and is in the form of a permanent bond adhesive.

10. A shipping label as defined in claim 9 wherein said front panel, said first and second intermediate panels and said back panel include marginal strips at said one ends thereof, said marginal strips being defined by lines of weakness formed in said panels, said second and third adhesive means acting between said respective panels intermediate the lines of weakness defining said marginal strips and said first lines of weakness.

11. A shipping label as defined in claim 10 wherein said front panel, said second intermediate panel and said back panel include marginal strips at the ends thereof opposite said one ends, said marginal strips being defined by lines of weakness formed in said panels, said fourth adhesive means acting between said front panel and said second intermediate panel between the lines of weakness defining said marginal strip and said second and third lines of weakness.

12. A shipping label as defined in claim 11 wherein said fifth adhesive means acts between the marginal strip at each end of said second intermediate panel and said back panel.

13. A shipping label as defined in claim 12 further including a cover panel overlying said front panel, said cover panel being joined to said front panel along said marginal strips.

14. A shipping label as defined in claim 11 further including sealing means on one of said first and second intermediate panels to seal said envelope upon removal of said envelope from said shipping label.

* * * * *